US005806198A

United States Patent [19]

Guillermin

[11] Patent Number: 5,806,198

[45] Date of Patent: Sep. 15, 1998

[54] TEMPLATE FOR CALIBRATING AN OPHTHALMIC LENS GRINDING MACHINE, AND CORRESPONDING CALIBRATION METHOD

[75] Inventor: Laurent Guillermin, Paris, France

[73] Assignee: Essilor International Compagnie Generale d'Optique, Charenton le Pont, France

[21] Appl. No.: 637,102

[22] Filed: Apr. 24, 1996

[30] Foreign Application Priority Data

May 24, 1995 [FR] France ..... 95 06239

[51] Int. Cl.[6] ..... G01B 5/00

[52] U.S. Cl. ..... 33/502; 33/507

[58] Field of Search ..... 33/200, 502, 507, 33/562, 567; 73/1.79, 1.81

[56] References Cited

U.S. PATENT DOCUMENTS

| | | | |
|---|---|---|---|
| 69,953 | 10/1867 | Richards | 33/567 |
| 2,190,582 | 2/1940 | Wolf | 33/507 |
| 2,317,925 | 4/1943 | Lewis | 33/507 |
| 3,501,842 | 3/1970 | Beasley | 33/507 |
| 4,299,032 | 11/1981 | Young | 33/200 |
| 4,596,091 | 6/1986 | Daboudet . | |
| 4,727,654 | 3/1988 | Cingone | 33/200 |
| 5,050,310 | 9/1991 | Jiles | 33/567 |
| 5,161,333 | 11/1992 | Lecerf . | |

FOREIGN PATENT DOCUMENTS 0391757 10/1990 European Pat. Off. .

*Primary Examiner*—Thomas B. Will
*Attorney, Agent, or Firm*—Young & Thompson

[57] ABSTRACT

Designed to be fitted to an ophthalmic lens grinding machine to be calibrated instead of an ophthalmic lens, a calibration template is in the general form of a disk with a circular contour over at least part of its perimeter. Its contour forms two localized angular points circumscribed by a common circumference and having a relative angular offset.

22 Claims, 2 Drawing Sheets

TEMPLATE FOR CALIBRATING AN OPHTHALMIC LENS GRINDING MACHINE, AND CORRESPONDING CALIBRATION METHOD

BACKGROUND OF THE INVENTION

1. Field of the Invention

The present invention is generally concerned with the calibration required on starting up an ophthalmic lens grinding machine to obtain a precise reference for its various parameters, it being understood that this calibration may then be repeated periodically, in particular on the occasion of changing or dressing a grinding wheel.

2. Description of the Prior Art

It is more specifically concerned with a template for such calibration and the calibration method using a calibration template of this kind.

SUMMARY OF THE INVENTION

The invention consists in a calibration template for calibrating an ophthalmic lens grinding machine, adapted to be mounted in place of an ophthalmic lens on the grinding machine to be calibrated and having the general shape of a disk, with a circular contour over at least part of its perimeter, said contour forming two localized angular points circumscribed by a common circumference and having a relative angular offset.

In accordance with the invention, and in a manner described in more detail below, the angular points are used to determine the angular position of the rotation axis of an ophthalmic lens in the rotation chassis of reference of the system so that the ophthalmic lens can be disposed on the required axis.

The calibration template of the invention has a beveled edge over at least part of the circular portion of its contour.

This bevel is used during calibration to determine the position of the groove in the grinding wheel, in the case of a finish grinding wheel, so that the bevel to be formed on the edge of the ophthalmic lens is subsequently positioned correctly on the latter.

The calibration template of the invention has a smooth cylindrical edge over at least part of the circular portion of its contour.

This smooth cylindrical portion of the edge of the calibration template of the invention is used during calibration to determine the overall diameter of a grinding wheel in the case of a roughing grinding wheel or a glass mode finish grinding wheel, so that the required oversize value for the corresponding blank can be complied with subsequently; using the beveled portion of this same edge, it is also possible to comply with the exact size of the finished ophthalmic lens.

The calibration template of the invention includes two hollow bosses with a relative angular offset, each projecting from a respective face and being continuous with the other, the bottom of each of said hollow bosses merging continuously with the top of the other via a linking wall common to the two hollow bosses and extending from one to the other thereof.

As described in U.S. Pat. No. 4,596,091 (filed as application Ser. No. 592,259 on 22 March 1984), the grinding machine includes at least one feeler which is applied to one or both faces of the ophthalmic lens to trace the trajectory in line with the end of the bevel to be formed; in this case, during calibration, the hollow bosses of the calibration template of the invention are used to verify the position of the feeler(s) on the grinding machine for subsequent determination of the position required for the ophthalmic lens.

The hollow bosses also have the advantage of enabling verification of the linearity of the feeler(s).

The features and advantages of the invention will emerge from the following description given by way of example with reference to the appended diagrammatic drawings.

DETAILED DESCRIPTION OF THE PREFERRED EMBODIMENT

Figure 1:
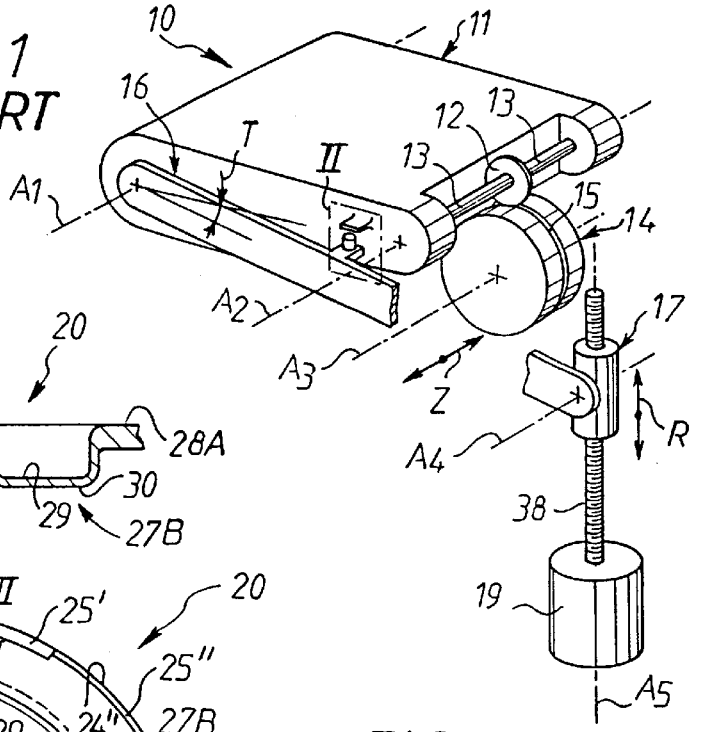
FIG. 1 PRIOR ART
FIG. 1 is a locally cutaway diagrammatic perspective view of an ophthalmic lens grinding machine to which the invention can be applied.
Figure 6:
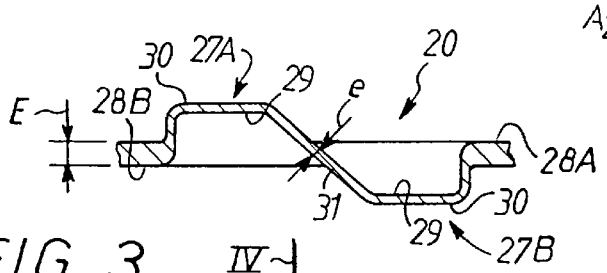
FIG. 6 is a partial view in circumferential section on the line VI—VI in FIG. 3, developed flat.
Figure 3:
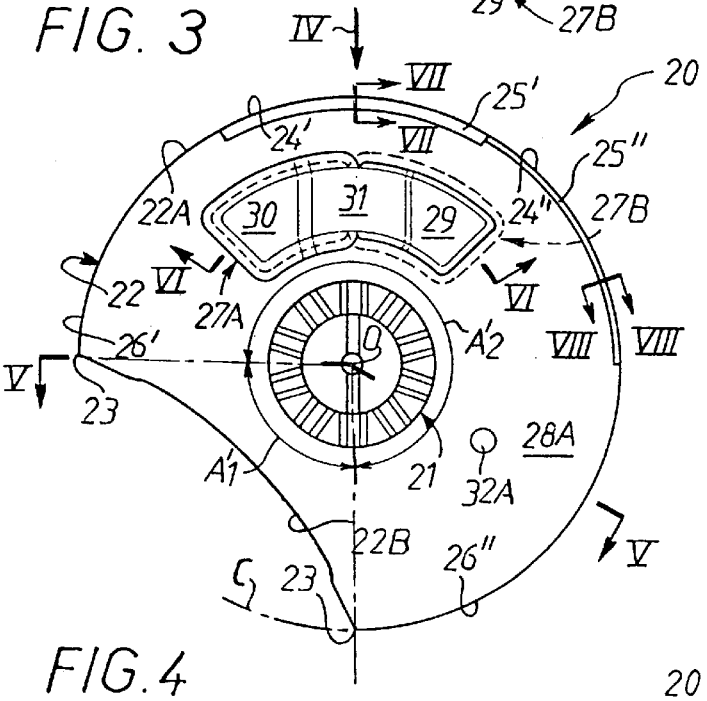
FIG. 3 is a front elevation view to a larger scale of the calibration template used in accordance with the invention to calibrate the grinding machine.
Figure 2:
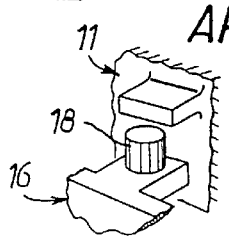
FIG. 2 PRIOR ART
FIG. 2 shows to a larger scale the part of FIG. 1 indicated by the chassis II in FIG. 1.
Figure 4:
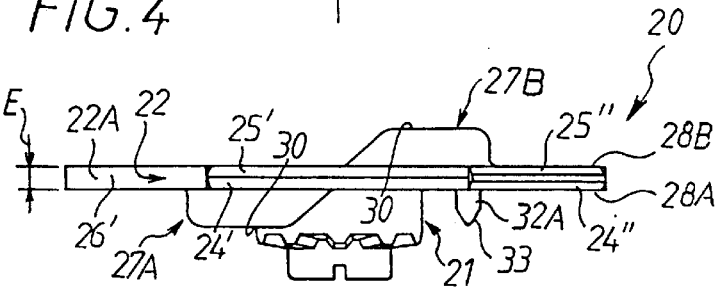
FIG. 4 is a top view of the calibration template as seen in the direction of the arrow IV in FIG. 3.
Figure 7:
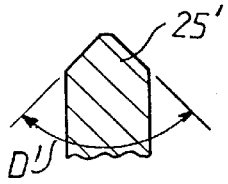
FIGS. 7 and 8 are respectively partial views in axial section on lines VII—VII and VIII—VIII in FIG. 3, to a larger scale.
Figure 5:
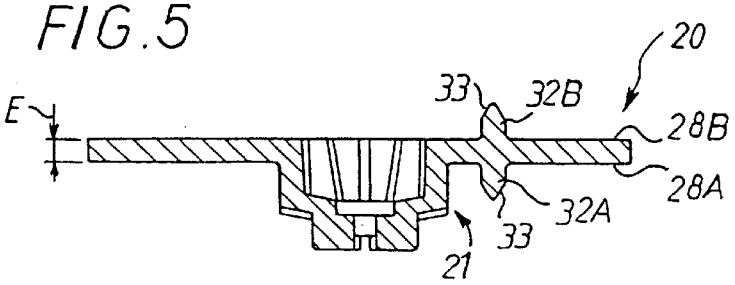
FIG. 5 is a view of it in axial section on the line V—V in FIG. 3.

As shown diagrammatically in FIG. 1, and in a manner that is known in itself, the grinding machine 10 in accordance with the invention includes a carriage 11 pivoting freely about a first axis A1, in practice a horizontal axis, on a chassis (not shown) and equipped with two support spindles 13 which support and hold an ophthalmic lens 12 to be machined, aligned with each other on a second axis A2 parallel to the first axis A1 and rotated by a motor (not shown). It further includes at least one grinding wheel 14 rotating about a third axis A3 parallel to the first axis A1 and also rotated by a motor (not shown).

For simplicity the axes A1, A2 and A3 are shown diagrammatically in chain-dotted line in FIG. 1.

In practice there is a plurality of parallel grinding wheels 14 on the third axis A3, for roughing and for finishing the ophthalmic lens 12 to be machined, and the whole system is carried by another carriage (not shown) that moves parallel to the first axis A1.

Only one grinding wheel 14 is shown in FIG. 1, and this is a finish grinding wheel having a groove 15 for machining a bevel on the ophthalmic lens 12.

The grinding machine 10 of the invention is in practice an automatic grinding machine, sometimes called a numerical grinding machine, and further includes a link 16 hinged to the chassis about the same first axis A1 as the carriage 11 at one end; its other end is hinged about a fourth axis A4 parallel to the first axis A1 to a nut 17 moving along a fifth axis A5, sometimes called the output axis, perpendicular to the first axis A1. A contact sensor 18 is operative between the link 16 and the carriage 11.

As shown in FIG. 1, the nut 17 is a screwthreaded nut, for example, threaded onto a screwthreaded rod 38 aligned with the fifth axis A5 and rotated by a motor 19.

The contact sensor 18 is a Hall effect cell, for example.

When the ophthalmic lens 12 to be machined, gripped between the two support spindles 13, is brought into contact with the grinding wheel 14, material is removed until the carriage 11 comes into contact with the link 16 at the location of the contact sensor 18, which therefore detects such contact.

To machine a given contour on the ophthalmic lens 12, all that is required is for the motor 19 to move the nut 17 accordingly along the fifth axis A5, and at the same time for the respective drive motor to pivot the support spindle 13 about the second axis A2 so that all points on the contour of the ophthalmic lens 12 are successively ground.

In practice this two-fold operation is coordinated by an appropriately programmed control unit.

The above arrangements are well known in themselves, and as they are not of themselves relevant to the present invention they will not be described in more detail here.

Obviously, for correct execution of this two-fold operation, the various axes in question must be clearly located relative to each other.

To be more precise, the first axis A1 and the third axis A3 being fixed to the chassis of the system, the angular position of the second axis A2 relative to the third axis A3, defined by the angle T between the carriage 11 and the plane containing the first axis A1 and the third axis A3, must be identified in the rotational system of reference of the system.

Likewise, it must be possible to determine the position of the nut 17 along the fourth axis A4, which is diagrammatically represented by a double-headed arrow R in FIG. 1 since it is similar to a radius in the system of polar coordinates that it constitutes with the angle T. Finally, it must also be possible to determine the position of the grinding wheel 14 along the third axis A3, which is schematically represented by a double-headed arrow Z in FIG. 1 since it is similar to an "altitude".

The same obviously applies to the diameter of the grinding wheel 14, either its overall diameter or its diameter at the bottom of the groove 15.

To identify these various positions it is necessary to calibrated the grinding machine 10 when it is started up, and this calibration must be repeated from time to time, in particular each time the grinding wheel 14 is changed or dressed.

The calibration template 20 shown in FIGS. 3 through 8 is intended to facilitate such calibration.

The calibration template 20 is designed to be mounted on the grinding machine 10 to be calibrated in place of an ophthalmic lens 12. It is generally disk-shaped, with a general thickness E, having a hollow boss 21 projecting from its central area to enable it to be mounted on the support spindles 13 of the grinding machine 10.

The contour 22 of the calibration template 20 is circular over at least part of its perimeter (see below) but forms two localized angular points 23 that are angularly offset from each other and circumscribed by a common circumference C.

Relative to the center 0 of the calibration template 20, the angular pointers 23 delimit two angles at the center.

A'1 is the smaller of these two angles at the center, and A'2 the greater.

The contour 22 of the calibration template 20 is in practice generally concave in the smaller angle A'1 at the center.

In the embodiment shown, the circumference C that circumscribes the two angular points 23 is that of the circular part 22A of the contour 22.

In this embodiment, the two angular points 23 are formed by the intersection of the circular part 22A with a notch 22B cut into the periphery of the calibration template 20.

In other words, in this embodiment, the contour 22 of the calibration template 20 in accordance with the invention has two parts, namely a circular part 22A subtending the greater angle A'2 at the center and a concave part that is formed by the notch 22B cut into its periphery and which subtends the smaller angle A'1 at the center.

The profile of the notch 22B itself is generally circular.

In the embodiment shown the two angular points 23 of the contour 22 are 90° apart.

In other words, the angle A'1 at the center that they subtend is equal to 90°.

Over at least a portion 24', 24" of the circular part 22A of its contour 22, the periphery of the calibration template 20 in accordance with the invention forms a bevel 25', 25".

In the embodiment shown, the periphery of the calibration template 20 in accordance with the invention in practice forms a bevel 25', 25" over at least two separate portions 24', 24" of the circular part 22A of its contour 22, and the corresponding bevels 25', 25" are different.

Figure 8:
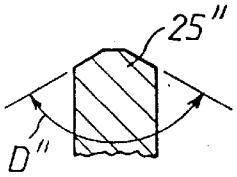

The dihedron D' formed by the bevel 25' is equal to 90°, for example (FIG. 7) whereas that D" that forms the bevel 25" is equal to 120° (FIG. 8).

In the embodiment shown the corresponding two portions 24', 24" of the periphery of the calibration template 20 are adjacent and, spaced from each of the angular points 23, each subtends an angle at the center substantially equal to 60°.

In this embodiment, the bevels 25', 25" each have their edge truncated by a cylindrical flat.

The periphery of the calibration template 20 in accordance with the invention is smooth and cylindrical over at least a portion 26', 26" of the circular part 22A of its contour 22.

In the embodiment shown, there are in practice two smooth and cylindrical portions 26', 26", each running from one of the two angular points 23.

The portion 26' subtends an angle at the center substantially equal to 60° and the portion 26" subtends an angle at the center substantially equal to 90°.

The calibration template 20 in accordance with the invention further includes two hollow bosses 27A, 27B with a relative angular offset, each projecting from a respective face 28A, 28B and continuous with the other, the bottom 29 of each of the hollow bosses 27A, 27B merging continuously with the top 30 of the other via a linking wall 31 which, common to the two hollow bosses 27A, 27B, extends from one to the other of the latter through the general thickness E of the calibration template 20.

In the embodiment shown, the linking wall 31 is in practice oblique to the faces 28A, 28B, being at an angle in the order of 45° to each of them, for example, and is a plane wall with a thickness e, which is the same as that of all of the walls of the hollow bosses 27A, 27B, significantly less than the general thickness E of the calibration template 20.

In the embodiment shown, the hollow bosses 27A, 27B extend generally circumferentially, at a distance from the circular part 22A of the contour 22, within the larger angle A'2 at the center.

The overall angle that they subtend at the center, measured from the radial end wall of one to the end wall of the other, is in the order of 90°.

The bottom 29 of the hollow bosses 27A, 27B is flat in practice, and substantially parallel to the faces 28A, 28B of the calibration template 20.

The other walls of the hollow bosses 27A, 27B are substantially perpendicular to the faces 28A, 28B.

In the embodiment shown, the calibration template 20 in accordance with the invention has a peg 32A, 32B projecting from the respective faces 28A, 28B.

The pegs 32A, 32B on the two faces 28A, 28B are in line with each other.

In the embodiment shown they are generally perpendicular to the faces 28A, 28B and their end 33 is slightly blunted.

Use of the calibration template 20 in accordance with the invention entails a number of operations that are preferably carried out in the following order.

Figure 9A:
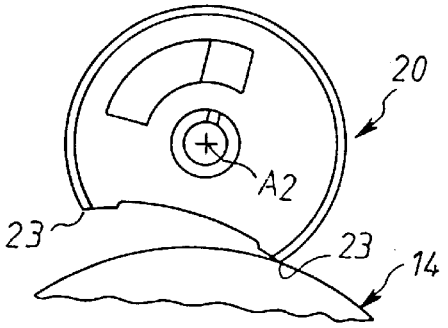
FIGS. 9A, 9B and 9C are diagrammatic elevation views derived from that of FIG. 3 and showing various phases in use of the calibration template of the invention.

First of all, after fitting the calibration template 20 to the support spindles 13 of the carriage 11, the carriage 11 is lowered under the control of the nut 17 until one of the angular points 23 of the calibration template 20 bears on the grinding wheel 14, as shown in FIG. 9A.

This contact is detected by the contact sensor 18 as soon as the nut 17 moves the link 16 away from the carriage 11.

Figure 9B:
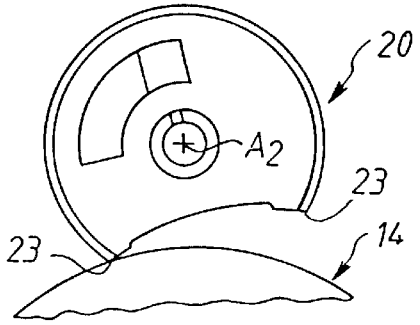

The angular position of the calibration template 20 is then incremented about the second axis A2 until its other angular point 23 bears on the grinding wheel 14, as shown in FIG. 9B.

As before, the contact sensor 18 detects this contact.

The position of the nut 17 on the fifth axis A5 is noted each time, and the operations are repeated until the corresponding value R is minimized.

Figure 9C:
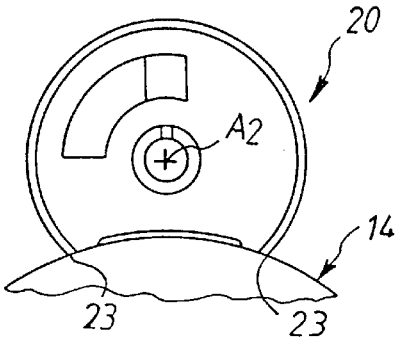

The two angular points 23 of the calibration template 20 then rest on the grinding wheel 14, as shown in FIG. 9C.

The angular value corresponding to the minimal value R obtained is placed in memory and is subsequently used as a reference for drawing up tables of set points for the second axis A2 for use subsequently, when machining an ophthalmic lens 12.

In a similar way, the appropriate bevel 25', 25" of the calibration template 20 is then applied to the groove 15 on the grinding wheel 14.

Figure 10A:
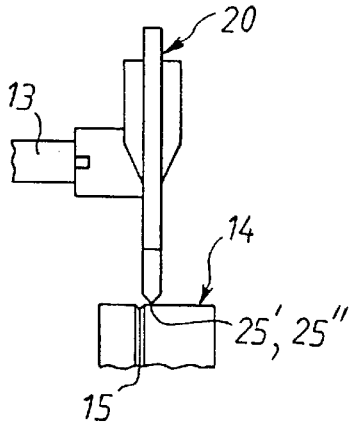
FIGS. 10A and 10B are side views relating to other phases of such use.

In practice, it is initially placed away from the groove 15, as shown in figure 10A; after raising it slightly so that it does not rub on the grinding wheel 14, the grinding wheel 14 is moved slightly along the second axis A2 until it contacts the calibration template 20 again; each time the relative positions of the second and third axes A2, A3 are noted and the operations are repeated until the value of the distance between them is minimized.

Figure 10B:
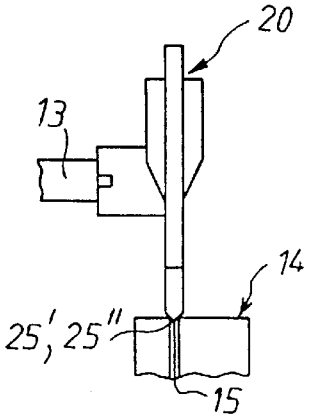

The calibration template 20 is then in the position shown in figure 10B, with its bevel 25' or 25" engaged in the groove 15 in the grinding wheel 14.

The value of the position Z of the grinding wheel 14 on the third axis A3 is then placed in memory and is used subsequently to draw up set point tables.

These operations also determine the diameter of the grinding wheel 14 at the bottom of its groove 15 if, as here, it is a finish grinding wheel; similar operations utilizing a smooth and cylindrical portion 26', 26" of the calibration template 20 determine the overall diameter of the grinding wheel 14 in the case of a roughing grinding wheel.

In both cases the corresponding value is placed in memory and used subsequently to draw up set point tables.

If, as described in the above mentioned U.S. Pat. No. 4,596,091, the grinding machine 10 includes at least one feeler 35, for example two feelers 35 as shown here, the linearity of the latter is checked after verifying their position visually using the pegs 32A, 32B.

To do this the feelers 35 are first moved fully back, so that the origin of their respective local chassis of reference is well defined.

Figure 11:
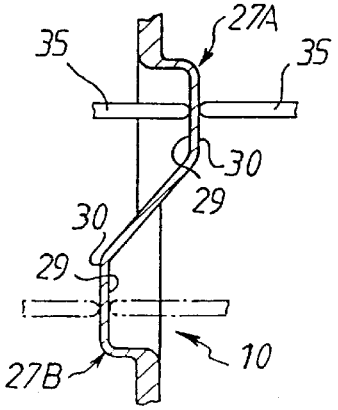
FIG. 11 is a view in circumferential section derived from that of FIG. 6 and also relating to another phase of such use.

They are then moved until one rests on the bottom 29 of the hollow boss 27A and the other on the top 30 of the same hollow boss 27A, as shown in continuous line in FIG. 11, and their relative displacements are noted.

The calibration template 20 is then pivoted about the second axis A2 until the feelers 35 contact the bottom 29 and the top 30 of the hollow boss 27B, as shown in chain-dotted line in FIG. 11.

The new displacements noted, together with those noted previously, are used to solve the equations with two unknowns determining the parameters of the linear relationship of the feelers 35.

These parameters must be near the corresponding theoretical values.

Otherwise, the feelers would not conform.

If the feelers do conform, the values are placed in memory, as previously.

The various above operations can naturally be effected automatically, during a calibration cycle, under the control of the control unit of the grinding machine 10, which is appropriately programmed for this purpose.

The present invention is naturally not limited to the embodiment described and shown, but encompasses any variant execution and/or implementation, in particular with regard to the order of the operations to be carried out to use the calibration template of the invention.

There is claimed:

1. Calibration template for calibrating an ophthalmic lens grinding machine having at least one grinding wheel, comprising means for mounting the template on a grinding machine in place of a lens blank to be ground, the calibration template having the general shape of a disk, a convex circular contour over part of its perimeter, said circular contour forming two localized angular pointers lying on a common circumference and circumferentially spaced from each other and a concave contour extending between the circumferentially spaced angular pointers.

2. Calibration template according to claim 1, wherein said convex circular contour subtends a first central angle and the concave contour subtends a second central angle smaller than the first central angle.

3. Calibration template according to claim 1, wherein said common circumference coincides with said convex circular contour.

4. Calibration template according to claim 3, wherein said two angular pointers are formed by the intersection of said convex circular contour and said concave contour.

5. Calibration template according to claim 1, wherein said two angular pointers subtend a central angle of about 90°.

6. Calibration template according to claim 1, wherein said convex circular contour has a periphery with a bevel extending along at least a portion thereof.

7. Calibration template according to claim 1, wherein said convex circular contour has a periphery with a bevel extending along at least two separate portions thereof, said bevels being different from each other.

8. Calibration template according to claim 1, wherein at least a portion of said convex circular contour has a periphery which is smooth and cylindrical.

9. Calibration template according to claim 1, wherein the template has respective faces, the means for mounting the template comprising two hollow bosses relatively circumferentially spaced from each other and projecting from respective faces of the template of disk shape and continuous with each other, bottom walls of said hollow bosses merging continuously with top walls of the other of said hollow bosses along a connecting wall common to said two hollow bosses and extending from one of said hollow bosses to the other.

10. Calibration template according to claim 9, wherein said connecting wall is disposed generally obliquely to the respective faces.

11. Calibration template according to claim 9, wherein said connecting wall is planar.

12. Calibration template according to claim 9, wherein said bottom walls of said two hollow bosses are flat.

13. Calibration template according to claim 12, wherein said bottom walls of said two hollow bosses are parallel to the respective faces of the template.

14. Calibration template according to claim 9, wherein said two hollow bosses extend generally circumferentially.

15. Calibration template according to claim 1, further comprising a peg projecting from respective faces of the template of disk shape.

16. Calibration template according to claim 15, wherein said pegs are in line with each other.

17. Calibration template according to claim 1, wherein the means for mounting the template comprises a boss.

18. Calibration template according to claim 1, wherein the means for mounting the template comprises a hollow boss.

19. Calibration template for calibrating an ophthalmic lens grinding machine having at least one grinding wheel, comprising means for mounting the template on a grinding machine in place of a lens blank to be ground, the calibration template having the general shape of a disk, a circular contour over part of its perimeter, said circular contour forming two localized angular pointers lying on a common circumference and circumferentially spaced from each other, said angular pointers being selectively and jointly cooperable with the periphery of the at least one grinding wheel of the grinding machine.

20. Calibration template according to claim 19, wherein the calibration template has at least one first position in which a first angular pointer is cooperable with the periphery of the at least one grinding wheel and at least one second position in which the other of said angular pointers is cooperable with the periphery of the at least one grinding wheel and a third position in which the two angular pointers are both cooperable with the periphery of the at least one grinding wheel.

21. A method for calibrating an ophthalmic lens grinding machine having at least one grinding wheel and using a calibration template of the kind comprising means for mounting the template on the grinding machine in place of a lens blank to be ground, the calibration template having the general shape of a disk and a circular contour extending over part of the perimeter thereof, the circular contour forming two localized angular pointers lying on a common circumference and circumferentially spaced from each other and a concave contour extending between the circumferentially spaced angular pointers, the method comprising the steps of:

a) mounting the template on the grinding machine in place of an ophthalmic lens to be ground;

b) bringing a first angular pointer into contact with the periphery of the grinding machine and detecting contact;

c) bringing a second angular pointer into contact with the periphery of the grinding wheel and detecting contact; and d) bringing both of the angular pointers both into contact with the periphery of the grinding wheel.

22. A method for calibrating an ophthalmic lens grinding machine according to claim 21, wherein steps b) and/or c) are repeated until the position corresponding to step d) is obtained.

* * * * *